US008231309B2

(12) United States Patent
Jones et al.

(10) Patent No.: US 8,231,309 B2
(45) Date of Patent: Jul. 31, 2012

(54) PIER BRACKET

(75) Inventors: Donald W. Jones, Springfield, OR (US); Brian W. Jones, Springfield, OR (US)

(73) Assignee: Willamette Graystone, Inc., Eugene, OR (US)

( * ) Notice: Subject to any disclaimer, the term of this patent is extended or adjusted under 35 U.S.C. 154(b) by 305 days.

(21) Appl. No.: 12/635,585

(22) Filed: Dec. 10, 2009

(65) Prior Publication Data

US 2011/0142547 A1 Jun. 16, 2011

(51) Int. Cl.
*E02D 27/32* (2006.01)

(52) U.S. Cl. ..... 405/229; 405/244; 405/232; 52/296; 52/295

(58) Field of Classification Search ..... 405/229, 405/230, 231, 232, 244; 52/831, 292, 294, 52/295, 296, 297, 298
See application file for complete search history.

(56) References Cited

U.S. PATENT DOCUMENTS

| | | | | | |
|---|---|---|---|---|---|
| 862,355 | A | * | 8/1907 | Stoneburner | 52/295 |
| 1,039,382 | A | | 9/1912 | Goldner | |
| 1,095,683 | A | | 5/1914 | Stambach | |
| 1,354,549 | A | | 10/1920 | Gilmer | |
| 1,606,697 | A | * | 11/1926 | Dean | 52/295 |
| 2,808,286 | A | | 1/1957 | Lyon | |
| 3,214,802 | A | | 4/1963 | Davis | |
| 3,352,191 | A | | 11/1967 | Crawford | |
| 3,417,525 | A | * | 12/1968 | Dashio | 52/298 |
| 3,563,582 | A | | 2/1971 | Shroyer et al. | |
| 3,998,026 | A | * | 12/1976 | Allen | 52/295 |
| 4,329,826 | A | * | 5/1982 | Flogaus et al. | 52/295 |
| 4,454,699 | A | | 6/1984 | Strobl | |
| 4,910,934 | A | * | 3/1990 | Hennings | 52/295 |
| 4,924,648 | A | * | 5/1990 | Gilb et al. | 52/295 |
| 4,947,610 | A | | 8/1990 | Koerner | |
| 5,422,789 | A | | 6/1995 | Fisher et al. | |
| 5,439,308 | A | | 8/1995 | Beaulieu | |
| 5,456,441 | A | * | 10/1995 | Callies | 52/295 |
| 5,467,569 | A | * | 11/1995 | Chiodo | 52/295 |
| 5,575,130 | A | * | 11/1996 | Chiodo | 52/295 |
| 5,595,031 | A | * | 1/1997 | Commins | 52/295 |
| 5,666,774 | A | * | 9/1997 | Commins | 52/295 |
| 5,771,650 | A | | 6/1998 | Williams et al. | |
| 6,141,936 | A | * | 11/2000 | Butler, Jr. | 52/294 |
| 6,241,299 | B1 | | 6/2001 | Watt | |
| 6,461,084 | B1 | * | 10/2002 | Stuart | 405/244 |
| 6,651,400 | B1 | | 11/2003 | Murphy | |
| 7,094,003 | B2 | | 8/2006 | Faires et al. | |

* cited by examiner

*Primary Examiner* — Frederic L Lagman
(74) *Attorney, Agent, or Firm* — Marger Johnson & McCollom, P.C.

(57) ABSTRACT

A pier bracket comprises a metal bar having a plurality of bolt holes formed through a top half of the metal bar and a plurality of opposingly faced barbs extending from planar side surfaces in a lower half of the metal bar. The barbs are configured to provide asymmetrical resistance force to movement of the pier bracket when received within an aperture formed in a concrete pier or footing.

15 Claims, 2 Drawing Sheets

PIER BRACKET

BACKGROUND OF THE INVENTION

This invention relates generally to fasteners and more particularly to brackets for coupling vertical post supports to a concrete pier or footing.

Construction techniques require a solid foundation on which to rest a building or deck. Such foundations can take the form of slabs, piers, or footings. While it is important that construction foundations be stabilized, it may be just as important that support posts, plates and other construction members be properly affixed to the foundation so that the above-ground construction elements supported by the posts and plates are similarly stabilized.

One method for affixing construction materials to foundations is by direct connection. That is, a sill plate is directly affixed to the foundation using an epoxy and/or masonry connectors. Other methods involve using brackets affixed to the foundation on one end and to vertical support beams on the other end. A common such bracket is a 'Y-bracket' in which a lower dowel is dropped into a drilled hole on the concrete foundation and the vertical post sets on a horizontal portion of the bracket while fasteners are formed through the vertical portion of the Y-bracket and into the (oftentimes wood) vertical post support. A disadvantage of this is that the bracket can rotate within the hole when the post is subject to torque.

A popular type of foundation, particularly for above-ground decks and porches, is called a footing. A footing is typically formed from concrete in the shape of a rhomboid. The footing is typically set upon ground prepared to give the ground stability as by forming a concrete pier to bedrock, grading the surface of the ground flat with a layer of packet gravel, etc. A conventional footing has a wider lower portion that rests on the prepared ground, and a narrower upper portion that supports the superstructure of a building, deck, or patio. A vertical member, typically a 4"×4" wood post, is affixed to the footing as using the Y-bracket described above. But the need remains for other methods that improve upon these conventional means.

SUMMARY OF THE INVENTION

Briefly, the invention comprises, in a preferred embodiment, a metal bar having bolt holes formed in a top half, and oppositely-facing barbs on a lower half. The barbed end is press-fitted into a slot formed into a concrete pier. The angle of the barbs allows the bracket to be forced into the slot, but prevent it from easily being pulled out.

More generally, a pier bracket configured according to the invention comprises a metal bar having a plurality of bolt holes formed through a top half of the metal bar and a plurality of opposingly faced barbs extending from planar side surfaces in a lower half of the metal bar, said barbs being configured to provide asymmetrical resistance force to movement of the pier bracket when received within an aperture.

The pier bracket may or may not be preinstalled within a footing when sold so that, in a preinstalled form, the invention comprises a footing having a slot formed in a top surface therein and a lower half of a pier bracket body installed within the slot. The lower half includes barbs formed on opposing sides of the pier bracket body; an upper (exposed) half having at least one bolt hole formed therethrough. The barbs formed on opposing sides of the lower half of the pier bracket body engage with opposingly-faced sides of the slot so as to prevent the pier bracket body from being easily pulled out of the slot.

Vertical support members may then be attached to the pier bracket by passing a bolt or other attachment member through the support member and bolt hole. The vertical support member may or may not be configured to rest upon the top surface of the footing.

The invention also describes a method for supporting a vertical structure on a pier or footing. The method comprises installing only a portion of a pier bracket body within an aperture formed within the pier or footing so that an upper portion of the pier bracket body extends above a top surface of the pier or footing. Opposing inner walls of the aperture are engaged with barbs formed in the installed portion of the pier bracket body and extending from planar side surfaces of the pier bracket body. Then, at least one vertical structure is affixed to the upper portion of the pier bracket body.

The foregoing and other objects, features and advantages of the invention will become more readily apparent from the following detailed description of a preferred embodiment of the invention that proceeds with reference to the accompanying drawings.

DETAILED DESCRIPTION

Figure 1:
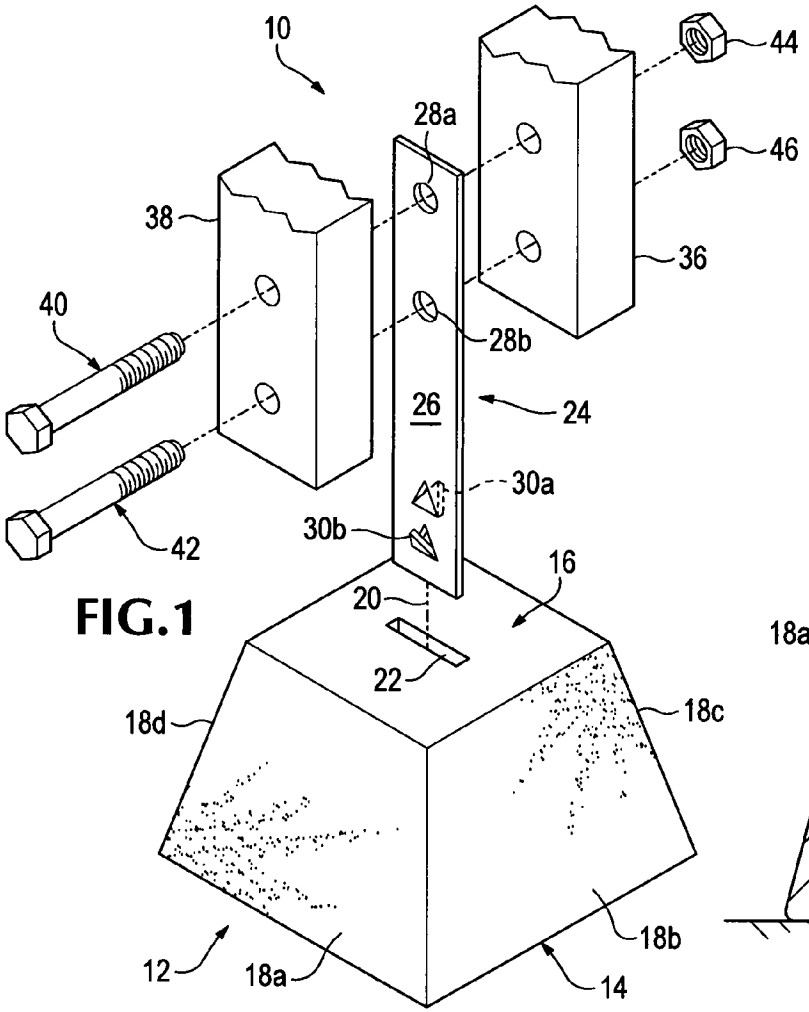
FIG. 1 is an exploded perspective view of a pier bracket, configured according to a preferred embodiment of the invention, in use to affix vertical posts to a concrete footing.

FIG. 1 illustrates an assembly 10 in exploded form to show each element of the assembly. Assembly 10 includes a footing or pier 12 of a generally rhomboid shape so that a lower base portion—expressed by a lower resting surface 14 [FIG. 2]—has a larger surface area than an upper supporting surface 16. The rhomboid footing 10 is completed by side surfaces 18*a*, 18*b*, 18*c*, and 18*d* rising inwardly at an oblique angle from lower resting surface 14 to upper supporting surface 16.

Figure 2:
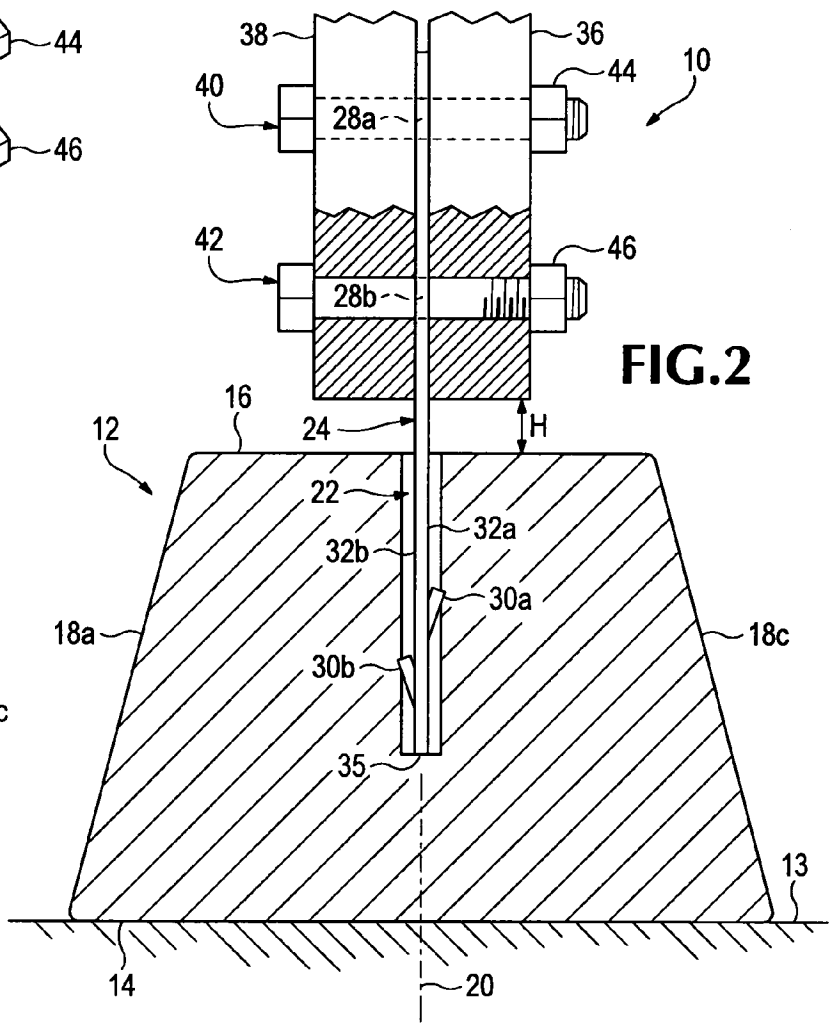
FIG. 2 is a partially sectioned side elevation view of the pier bracket assembly of FIG. 1.

Footing 12 is preferably formed as a solid concrete block to give it mass and stability when resting on solid ground 13 [FIG. 2], although other materials and shapes are possible within the scope of the invention. It may also be possible that footing 12 is a hollow form bound by surfaces 14, 16, and 18*a*-18*d*. Preferably, however, footing 12 is symmetric about a vertical axis 20 so as to prevent imbalance and tipping when the assembly 10 is fully constructed.

Footing 12 includes a slot 22 or aperture formed into the interior body of the footing through the upper supporting surface 16. Slot 22 is sized in cross-section to closely accept a lower half of pier bracket 24 and may be centrally located within upper surface 16 on vertical axis 20 (as in FIGS. 1-2) or formed off-center from the vertical axis 20 (as in FIGS. 3-4). The choice of on-center or off-center is generally made depending upon the configuration of vertical support members [described below] so that such members as positioned generally centrally with respect to the vertical axis 20.

Pier bracket 24 comprises in a preferred embodiment a metal bar 26 having a plurality of bolt holes—such as bolt holes 28*a* and 28*b*—formed through a top half of the metal bar 26 and a plurality of opposingly-facing barbs—such as barbs 30*a* and 30*b*—extending from planar side surfaces in a lower (inserted) half of the metal bar. Barbs 30*a*, 30*b* are configured to provide asymmetrical resistance force to movement of the pier bracket when received within slot 22. That is, in a preferred embodiment as shown, opposingly-facing barbs extend outwardly from planar side surfaces 32*a* and 32*b*, respectively, of metal bar 26 at an oblique angle so that resistance to insertion within slot 22 is less than resistance to removal from slot 22. That is, and referring specifically to FIG. 4, each of the opposingly faced barbs 30*a*, 30*b* are formed to include a triangular section of the metal bar 26 with an upwardly-facing point, 31*a* and 31*b*, cut from the metal bar 26 and bent outward in opposite directions from the planar side surfaces 32*a*, 32*b* by a resting oblique angle A so that a lower tab portion, 33*a* and 33*b*, respectively [FIG. 4], of the triangular sections remain attached to the metal bar.

Figure 4:
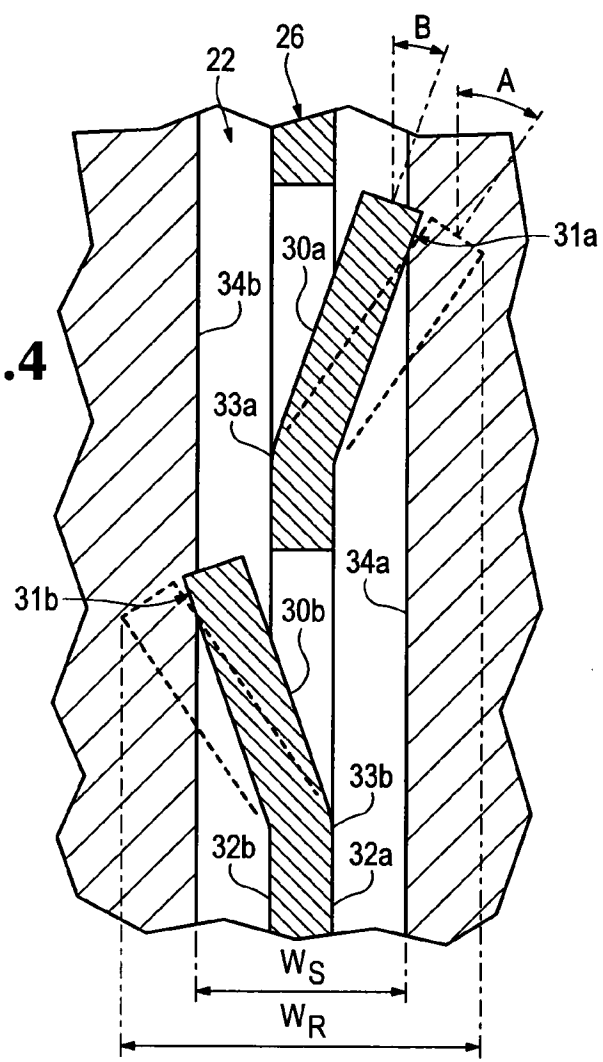
FIG. 4 is a side elevation view taken in section along a centerline of the pier bracket of FIG. 1, showing deflection of the barbs of the bracket when installed within the slot of a footing.

FIG. 4 illustrates a sectioned side view showing a close-up of barbs 30*a*, 30*b* inserted within slot 22, where slot 22 is bounded by inner walls 34*a* and 34*b* and a bottom wall 35. Walls 34*a*, 34*b* are spaced from one another by a slot width $W_S$. Slot width $W_S$ is sized to be less that a resting-width $W_R$ between points 31*a*, 31*b* of the pier bracket 24. That is, a width $W_R$ between barbs 30*a*, 30*b* (illustrated by the barbs shown in phantom outline in FIG. 4) is greater than the slot width $W_S$ so that the barbs are required to deflect to an oblique angle B (shown by the barbs in solid lines in FIG. 4) and approximate width $W_S$ when the pier bracket body 24 is installed within the slot 22. Resting angle A is less than deflected angle B so that a resilient biasing toward the resting angle A occurs about tabs 33*a*, 33*b*.

In this inserted configuration, barbs 30*a* and 30*b* are maintained in a outwardly biased position so that the pointed sections 31*a* and 31*b* dig against and bind upon the slot inner walls, 34*a* and 34*b*, respectively, so that the pointed sections point upward and into the inner walls. In this preferred configuration, the barbs require a greater force for removal from the slot as compared to insertion within the slot because the upwardly sloping sides of barbs 30*a* and 30*b* are obtuse with respect to the downward insertion force but acute with respect to the upward removal force. In this way, the pier bracket 24 is stably maintained within slot 22.

Turning back to FIG. 1 and also to FIG. 2, assembly 10 includes first and second vertical post members 36 and 38 that are affixed to the upper half of the pier bracket using fasteners, such as carriage bolts 40 and 42, that pass through respective pier bracket bolt holes 28*a* and 28*b*. Bolts 40, 42 pass completely through complementary apertures formed through post members 36, 38 axially aligned with respective pier bracket bolt holes 28*a*, 28*b* and are affixed together using nuts 44 and 46. As shown in the embodiment of FIGS. 1 and 2, the plurality of bolt holes 28*a* and 28*b* are formed through the top half of the metal bar 26 and centered along the long axis of the metal bar. Vertical post members 36, 38 are attached on either side of the metal bar 26 so that post 36 is adjacent side 32*a* of bar 26 and post 38 is adjacent side 32*b*. In this configuration, post members 36, 38 sandwich the upper half of pier bracket 24 therebetween so that the assembly 10 is substantially symmetrical about a central vertical axis 20 of the assembly and long axis of the metal bar 26.

Figure 3:
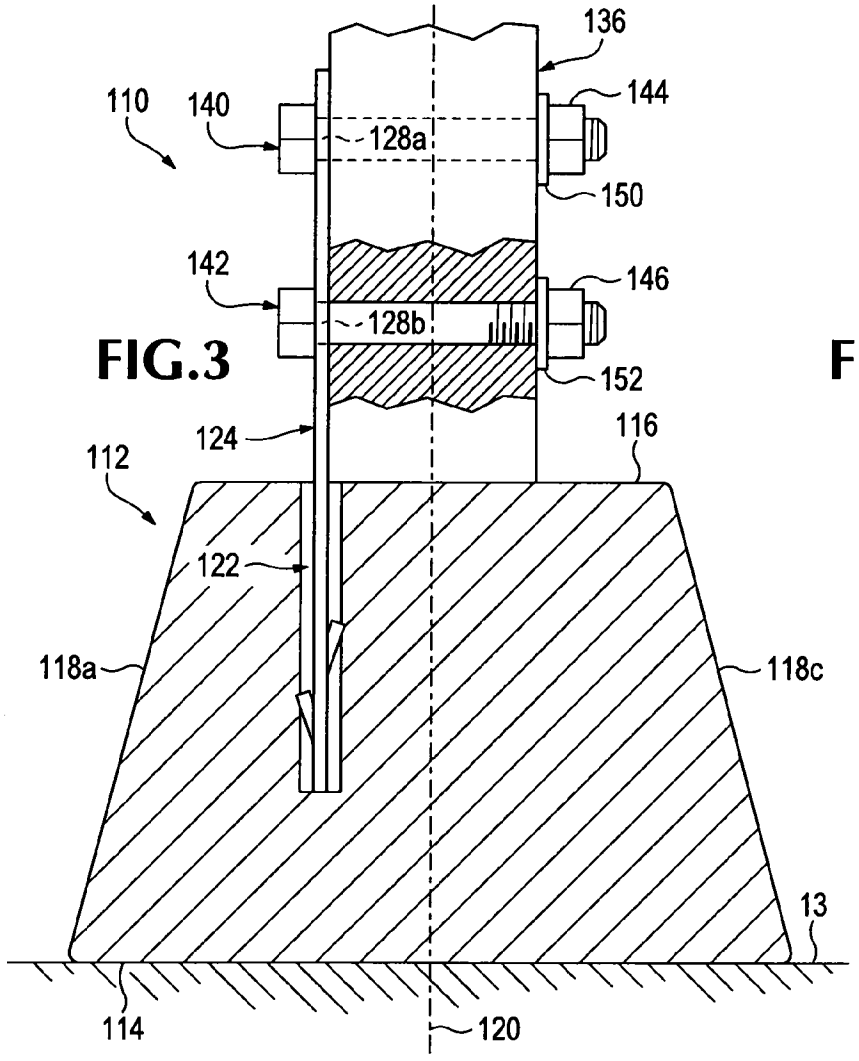
FIG. 3 is a partially sectioned side elevation view of the pier bracket assembly configured in an alternate embodiment to support a single vertical post.

And as building codes may require that wood in contact with concrete be pressure treated, unpressured treated wood may be suspended from contact with a top surface 16 of the concrete footing 12 by height H. Alternately, and as shown in FIG. 3, pressure treated wood may be in contact with and rest upon the top surface of the footing. A still further embodiment would be to interpose a vapor barrier, e.g. an asphalt shingle, between the non-pressure-treated wood post and the concrete footing.

FIG. 3 illustrates a partial side section view of an alternate assembly 100 of the invention. Similar parts are numbered the same as in FIGS. 1, 2 and 4 and not described further here. Assembly 100 includes a concrete footing 112 with bottom resting surface 114 sitting on ground 13, top supporting surface 116, and side surfaces 118*a*, 118*c* shown. A slot 122 is formed through top surface 116 and into the interior of footing 112, wherein the slot 122 is formed off-center to a central axis 120 of the assembly passing through the top surface 116 of the footing 112.

A first vertical post member 136 is affixed to pier bracket 124 using a fastener, such as carriage bolts 140 and 142, passing through respective bolt holes 128*a* and 128*b* formed in an upper half of the bracket 124. Bolts 140, 142 are held in place by bolts 144, 146 and washers 150, 152. As with the embodiment shown in FIGS. 1-2, and 4, the lower half of bracket 124 may be fully inserted within slot 122 so that a bottom portion of the bracket rests upon a bottom wall of the slot 122 and the barbs deflect inward to accommodate the width of the slot. Differently from the first embodiment, however, is that fact that the vertical post 136 is a 4"×4" pressure-treated vertical support post that may rest directly upon the sop surface 116 of concrete footing 112 by code. The slot 122 is spaced from the vertical centerline 120 of the assembly 100 so that the vertical support post 136 rests approximately centrally upon the top surface of footing 112 to limit tipping.

The invention also describes a method for supporting a vertical structure on a pier or footing. The method comprises installing only a portion of a pier bracket body within an aperture formed within the pier or footing so that an upper portion of the pier bracket body extends above a top surface of the pier or footing. Opposing inner walls of the aperture are engaged with barbs formed in the installed portion of the pier bracket body and extending from planar side surfaces of the pier bracket body. Then, at least one vertical structure is affixed to the upper portion of the pier bracket body.

In the above method, the step of installing only a portion of the pier bracket body includes press-fitting the pier bracket body into the aperture in a direction along a long axis of the pier bracket body.

Where the pier bracket body includes at least one bolt hole formed therethrough, the step of affixing at least one vertical structure to the upper portion of the pier bracket body includes affixing the vertical structure through the bolt hole.

Where the pier bracket body is bar shaped characterized by planar side surfaces, the barbs are portions of the side surfaces bent outward from the planar portions of the side surfaces by an amount so that a width between barbs is greater than the aperture and so that the barbs are required to deflect when the pier bracket body is installed within the aperture.

In the above method, the step of engaging opposing inner walls of the aperture includes biasing pointed sections of the barbs against the inner walls so that the pointed sections point upward and into to inner walls.

In the above method, and as shown in FIG. 3, the step of installing includes installing the pier bracket body off-center from the top surface of the footing. Alternately, the step of installing includes installing the pier bracket body centered on the top surface of the footing as shown in FIGS. 1-2.

Having described and illustrated the principles of the invention in a preferred embodiment thereof, it should be apparent that the invention can be modified in arrangement and detail without departing from such principles. For instance, different fasteners, materials, and the like may be used in the assembly in general and the pier bracket in particular without departing from the spirit and scope of the invention. We claim all modifications and variation coming within the spirit and scope of the following claims.

What is claimed is:

1. A pier bracket assembly comprising:

a concrete footing having a slot defined in a top surface thereof;

a pier bracket received in the slot, the pier bracket having barbs formed in a lower half of the bracket and at least one bolt hole formed in an upper half of the bracket, wherein the barbs extend upward at an oblique angle to side surfaces of the bracket to contact and frictionally engage inner walls of the slot; and a first vertical post member affixed to the bracket using a fastener passing through the bolt hole.

2. The pier bracket assembly of claim 1, wherein the first vertical post member is suspended from contact with the concrete footing.

3. The pier bracket assembly of claim 1, further including a second vertical post member affixed to the bracket using the bolt hole, the pier bracket being interposed between the first and second vertical posts so that the posts sandwich the bracket therebetween.

4. The pier bracket assembly of claim 3, wherein the fastener is a carriage bolt passing through the first vertical post member, the bolt hole, and the second vertical post member.

5. The pier bracket assembly of claim 1, wherein the barbs include a first barb extending obliquely from a first side of the bracket and a second barb extending obliquely from a second side of the bracket, wherein the first side is opposed to the second side so that the first and second barbs engage opposed inner walls of the slot.

6. The pier bracket assembly of claim 5, wherein the first and second barbs are characterized by triangular portions of pier bracket pushed outward from the side surfaces from an attachment point.

7. The pier bracket assembly of claim 1, wherein the side surfaces of the bracket are planar, the barbs extending outward from the planar side surfaces of the bracket such that a width of the bracket from barb to barb is greater than a width of the slot into which the bracket is received, the barbs deflecting to accommodate the width of the slot when the bracket is inserted and exhibiting an outward biasing force against inside walls of the slot.

8. The pier bracket assembly of claim 1, wherein the slot is formed off-center within the top surface of the footing.

9. A method for supporting a vertical structure on a pier or footing, the method comprising:

installing only a portion of a pier bracket body within an aperture formed within the pier or footing so that an upper portion of the pier bracket body extends above a top surface of the pier or footing;

engaging opposing inner walls of the aperture with barbs formed in the installed portion of the pier bracket body and extending from planar side surfaces of the pier bracket body;

affixing at least one vertical structure to the upper portion of the pier bracket body.

10. The method of claim 9, wherein the step of installing only a portion of the pier bracket body includes press-fitting the pier bracket body into the aperture in a direction along a long axis of the pier bracket body.

11. The method of claim 9, the pier bracket body including at least one bolt hole formed therethrough, wherein the step of affixing at least one vertical structure to the upper portion of the pier bracket body includes affixing the vertical structure through the bolt hole.

12. The method of claim 9, wherein the pier bracket body is bar shaped characterized by planar side surfaces and the barbs are portions of the side surfaces bent outward from the planar portions of the side surfaces by an amount so that a width between barbs is greater than the aperture so that the barbs are required to deflect when the pier bracket body is installed within the aperture.

13. The method of claim 9, wherein the step of engaging opposing inner walls of the aperture include biasing pointed sections of the barbs against the inner walls so that the pointed sections point upward and into to inner walls.

14. The method of claim 9, wherein the step of installing includes installing the pier bracket body off-center from the top surface of the footing.

15. The method of claim 9, wherein the step of installing includes installing the pier bracket body centered on the top surface of the footing.

* * * * *